US006279256B1

(12) United States Patent
Norolof et al.

(10) Patent No.: US 6,279,256 B1
(45) **Date of Patent: *Aug. 28, 2001**

(54) LABEL HOLDER

(76) Inventors: Jonas Norolof, Brusstigen 1, S-774 61 Avesto; Maro Lino, Dröngarne 8, S-776 90 Hedemora; Lars Back, Bladstigen 12, S-776 34 Hedemora, all of (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/982,908

(22) Filed: Dec. 2, 1997

(51) Int. Cl.[7] ..... G09F 3/00

(52) U.S. Cl. ..... 40/642.01; 40/657; 248/230.7; 248/291.1; 211/57.1

(58) Field of Search ..... 40/642.01, 657, 40/658, 642.02; 211/57.1, 59.1; 248/230.7, 291.1

(56) References Cited

U.S. PATENT DOCUMENTS

| | | | | |
|---|---|---|---|---|
| 4,593,824 | * | 6/1986 | Pfeifer | 40/642.01 |
| 5,442,872 | * | 8/1995 | Moser | 40/642.01 |
| 5,815,970 | * | 10/1998 | Thalenfeld et al. | 40/642.01 |
| 5,941,003 | * | 8/1999 | Thalenfeld | 40/658 X |

FOREIGN PATENT DOCUMENTS

| | | |
|---|---|---|
| 2585549 | 2/1987 | (FR) . |
| 2740891 | 5/1997 | (FR) . |
| 2257746 A | 1/1993 | (GB) . |
| WO 97/40724 | 11/1997 | (WO) . |

* cited by examiner

*Primary Examiner*—Joanne Silbermann

(57) ABSTRACT

The present invention relates to a label holder for use with T-shaped supports, which includes a substantially horizontal elongated cross-piece on a supporting arm and a label holder, wherein the label holder has a clamp for clamping onto the cross-piece and a brace for bracing against the supporting arm.

12 Claims, 4 Drawing Sheets

LABEL HOLDER

TECHNICAL FIELD OF THE INVENTION

The present invention relates to a display label attachment means of the type mentioned in the preamble of the independent claims.

DESCRIPTION OF RELATED ART

In many shops an article displaying bracket or holder unit known as a peghook display is provided for displaying unit packages. GB-A 2275807 shows a peghook display in which a backboard with a pattern of holes supports an array of projecting peghooks. Each of the peghooks projects substantially horizontally and has two vertically spaced arms. At the free end of the upper arm a label with an electronic display is provided while the lower arm acts as a goods bearing member on which the goods to be displayed may be hung. The label is hinged about a horizontal axis at the end of the upper arm and normally hangs downwards. It can however be pivoted about the horizontal axis and manually held out in a horizontal orientation to enable goods to be placed onto, and removed from, the lower arm.

A problem with such the label attaching means for peghook displays with pivotable labels is that as the label hangs vertically it may be difficult to read if it is too low or too high. This is particularly true if the label is a LCD electronic display which typically have only a narrow viewing angle i.e. it is only possible to read the display if the person looking at the display is looking nearly perpendicularly at the display. Another problem with such label attaching means can be that it requires the use of two hands to add goods to the goods bearing member—one hand to hold the label attaching means up out of the way of the goods bearing member and the other hand to feed goods onto the goods bearing member.

SUMMARY OF THE INVENTION

An object with the present invention is to overcome the problems of prior art label attaching means.

According to the invention this is achieved by a label attachment means having al least one bracing means which co-operates with the label supporting means such as a peghook arm. The bracing means has at least one bracing surface which can be selectively, individually brought into contact with the label holder. Each bracing surface causes the label holder to take up a predetermined angle with respect to the label supporting means. The bracing arm or label holder is preferably provided with retaining means for retaining the bracing surface in the desired position. This allows the angle to the vertical of the label to be adjusted and maintained so that it is at an optimum angle for reading.

BRIEF DESCRIPTION OF THE DRAWINGS

The present invention will now to illustrated by non-limiting examples of embodiments showing the appended drawings in which.

DETAILED DESCRIPTION OF THE EMBODIMENTS

Figure 1A:
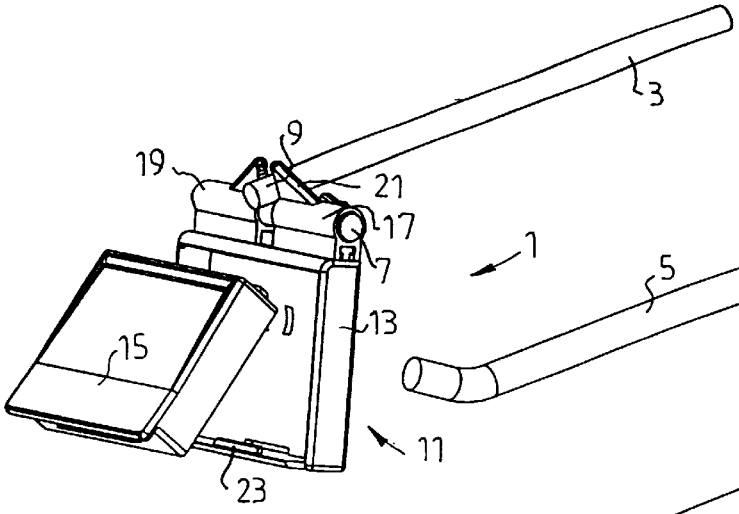
FIGS. 1*a*) and 1*b*) show perspective views of a first embodiment of an attachment means according to the present invention attached to a peghook arm.
Figure 1B:
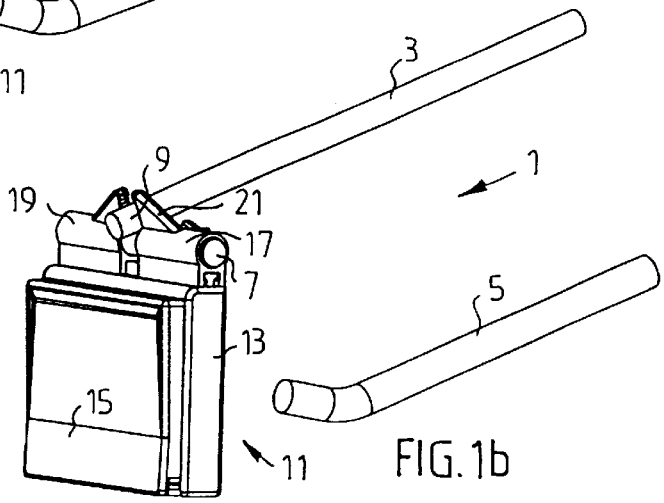

FIGS. 1*a*) and *b*) show a peghook display 1 comprising an upper label supporting bar 3 and a lower goods supporting bar 5. Upper bar 3 has a horizontal cross-piece 7 mounted symmetrically at its end 9 wherein the supporting bar 3 connects adjacent an intermediate portion of the cross-piece 7. A label attachment means 11 is pivotably mounted on cross-piece 7. Label attachment means 11 has a body 13 for receiving an electronic label 15. Label attaching means 11 is mounted on cross-piece 7 by means of a right-hand clamp member 17 and a left-hand clamp member 19. A bracing arm 21 mounted on the back of body 13 is in contact with upper bar 3. In FIG. 1*a*) label 15 is shown being fitted into body 13. Body 13 has a snap-in hook 23 which co-operates with a corresponding recess (not shown) on the underside of label 15 to retain label 15 in body 13. In FIG. 1*b*) label 15 is shown in the fitted position.

Figure 2A:
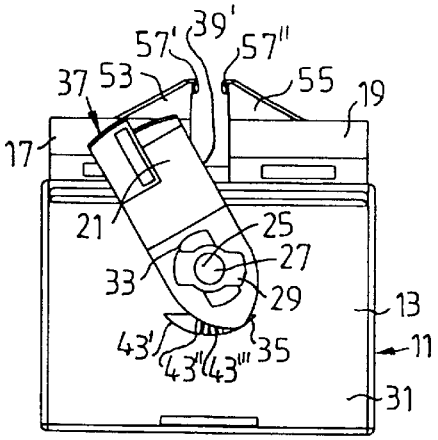
FIGS. 2*a*), 2*b*), 2*c*) shows front, side and rear views of the first embodiment of the attachment means shown in FIG. 1.
Figure 2C:
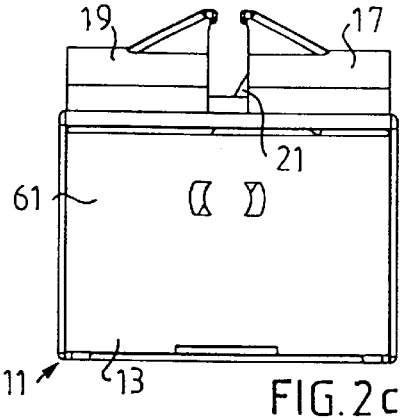
Figure 2B:
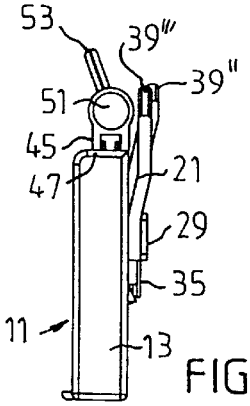

FIG. 2 shows in more detail label attaching means 11. FIG. 2*a*) shows a rear view of label attaching means 11 in which bracing arm 21 is shown rotatably mounted on a retaining pivot means 25 mounted on the rear of body 13. Pivot means 25 comprises a substantially T-shaped projection with a cylindrical body 27 and a flat cross-piece 29. Cross-piece 29 extends parallel to the rear surface 31 of body 13 and is at a distance equal or greater than the thickness of bracing arm 21 from the rear surface. Bracing arm 21 has a cutout 33 which has a shape which co-operates with the shape of crosspiece 29 so that in certain orientations bracing arm 21 can be threaded over cross-piece 29 and then rotated to other orientations in which it is not possible to remove it from pivot means 25. Cutout 33 is positioned near to a lower end 35 of bracing arm 21. Bracing arm 21 is substantially flat except for at a top end 37 which is bent out of the plane of the bracing arm to form a plurality of bracing surfaces 39', 39", 39'".

First bracing surface 39' is formed by a side edge of bracing arm 21 while second and third bracing surfaces 39" and 39'", respectively, are formed by the edge of top end 37. Second bracing surface 39" is a greater distance from the plane of bracing arm 21 than third bracing surface 39'". Bracing surfaces 39'–39'" are intended to co-operate with upper bar 3 in a manner described in more detail below in order to hold body 13 at predetermined angles with respect to bar 3. Bottom end 35 has a wedge-shaped projection 41 on the surface facing towards body rear surface 31 which has a plurality of spaced apart tapered projections 43', 43", 43'" facing towards projection 41. Projection 41 can fit into the spaces between adjacent projections 43', 43", 43" and the heights of projections 41, 43', 43", 43'" are such that bottom end 35 must be moved away from surface 31 in order to allow projection 41 to pass over any of the other projections 43', 43", 43'". Bracing arm 21 is therefore made of a resilient flexible material which allows bottom end 35 to be bent away from surface 31 and to then spring back into position after being released. The permits bracing arm to be maneuvered to a desired position and retained there by projection 41 co-operating with one or more of projections 43', 43", 43'''. Clamping members 17, 19 are slidably mounted on rails 45 on the top edge 47 of body 13 and retained on rails 45 by means of mutually co-operating snap-in retaining means (not shown). These retaining means preferably prevent clamping members 17, 19 from being removed from body 13. Clamping members 17, 19 are separated by a gap 49 which is equal or greater than the diameter of upper bar 3 to which the display 1 is to be attached. Each clamping member 17, 19 has a longitudinal hole 51 with a diameter greater or equal to the diameter of crosspiece 7 so that body 13 can pivot around cross-piece 7. Each clamping member 17 and 19 has a resilient wing 53 and 55, respectively, projecting away from body 13 at an angle $\alpha$ to the plane of body 13. Angle $\alpha$ determines the angle to the vertical that the label attachment means 11 takes up when allowed to hang freely from cross-piece 7. In this example of an embodiment angle $\alpha$ is about 20° and label attaching means 11 hangs freely at an angle of about −10° i.e. with the front face 61 of label attaching means 11 pointing downwards 10°. Each wing 53, 55 has a bracing surface 57' and 57", respectively, which project into gap 49. Bracing surfaces 57', 57" are so positioned that they are in contact with a side portion of bar 3 when body 13 has been pivoted around cross-piece 7 to a loading position where body 13 is no longer in font of lower bar 5. The resilient force provided by wings 53, 55 and acting between bracing surfaces 57', 57" and bar 3 is sufficient to retain body 13 in the loading position where goods can be loaded onto lower bar 5 without requiring the loader to hold body 13 in place.

Figure 3A:
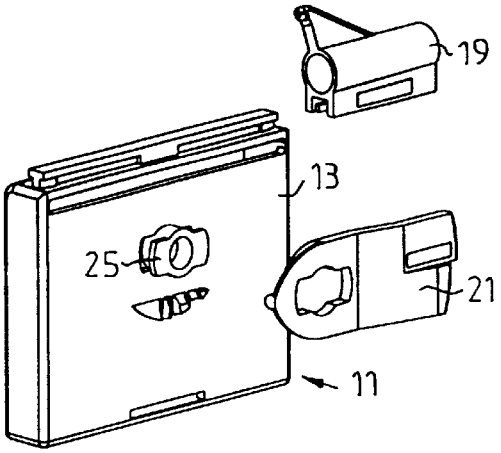
FIGS. 3*a*), 3*b*) shows stages in the assembly of a partly assembled first embodiment attachment means.
Figure 3B:
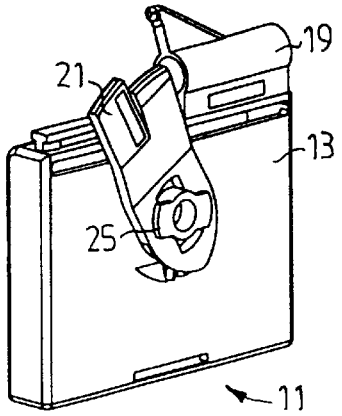

FIGS. 3–5 show how a label attaching means 11 according to the invention is assembled, fitted onto a peghook upper bar 3 and set at a desired angle. FIG. 3*a*) shows a rear view of label attaching means 11 with cutout 33 of bracing arm 21 aligned with pivot means 25, and left-hand clamping member 19 aligned with rail 45. FIG. 3*b*) shows bracing arm 21 after being threaded on pivot means 25 and subsequently rotated in order to prevent it being removed. Clamping member 19 has been slid on rail 45 to its working position and is held in place by snap-in locking means (not shown).

Figure 4A:
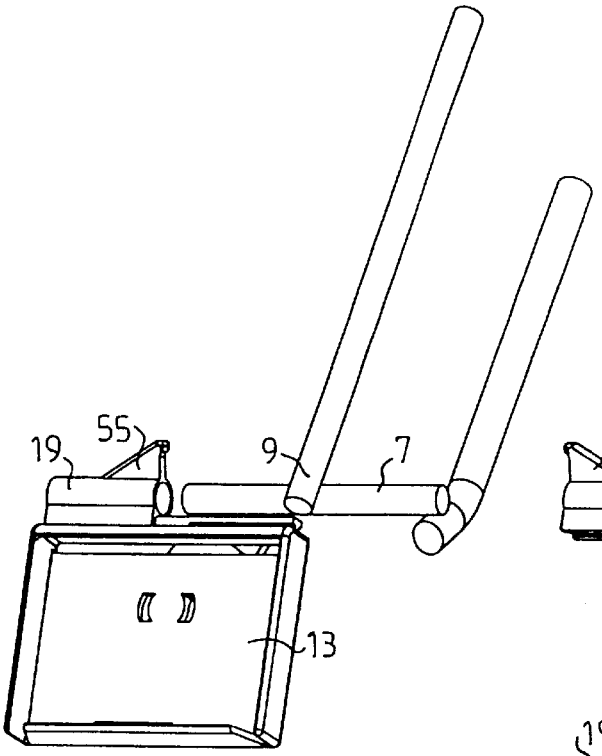
FIGS. 4*a*), 4*b*) shows stages of the mounting of the first embodiment of an attachment means on a peghook.

FIG. 4*a*) shows a front view of label attaching means 11 with the longitudinal hole 51 of left-hand clamping member 19 aligned with cross-piece 7. Right-hand clamping member 17 is also aligned for fitting onto with rail 45 and has its longitudinal hole 51 aligned with cross-piece 7.

Figure 4B:
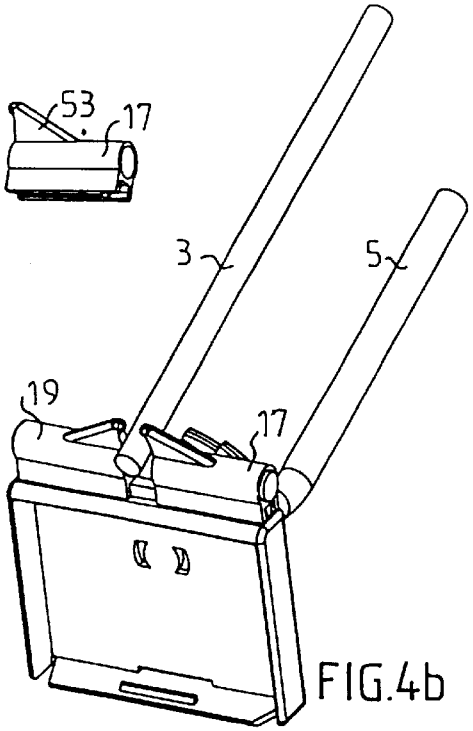

FIG. 4*b*) shows a front view of label attaching means 11 after the longitudinal hole 51 has been slid onto cross-piece 7 and right-hand clamping member 17 has been slid simultaneously along rail 45 and crosspiece 7 to its working position opposite left-hand clamping member 19. The snap-in cooperation between clamping members 17, 19 and rail 45 prevent label attaching means 11 from being removed from cross-piece 7.

Figure 5A:
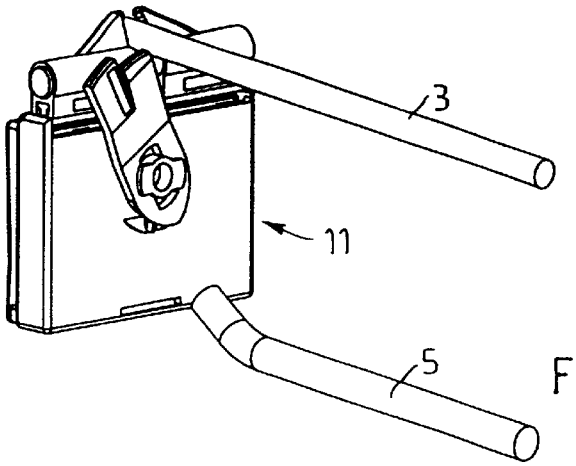
FIGS. 5*a*), 5*b*), 5*c*) shows the first embodiment of an attachment means in a plurality of different orientations.

FIG. 5*a*) shows a view from the rear of label attaching means 11 in which bracing arm 21 is positioned with first bracing surface 39' in contact with the underside of upper bar 3. This prevents label attaching means 11 from hanging freely and in this example the position of bracing surface 39' on bracing arm 21 causes the front face 61 of label attaching means 11 to be orientated at an angle of −5°, i.e. it faces downwards at an angle of 5°.

Figure 5B:
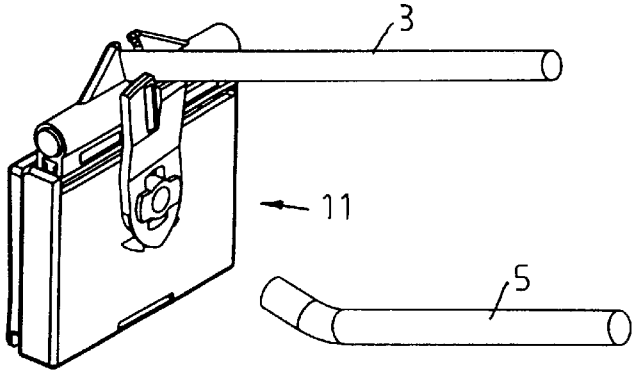

FIG. 5*b*) shows a view from the rear of label attaching means 11 in which bracing arm 21 is positioned with second bracing surface 39" in contact with the underside of upper bar 3. In this example the position of bracing surface 39" on bracing arm 21 causes the front face 61 of label attaching means 11 to be orientated at an angle of 20°, i.e. it faces upwards at an angle of 20°.

Figure 5C:
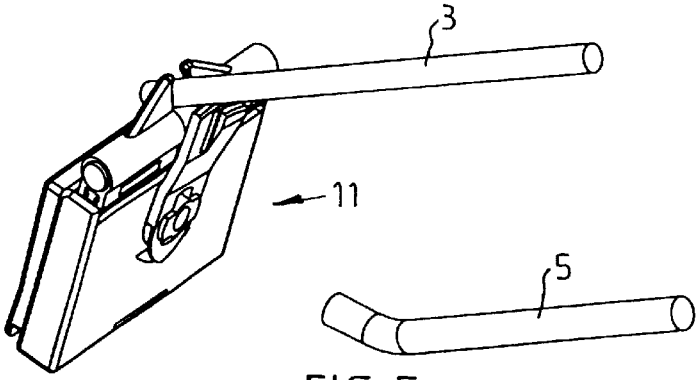

FIG. 5*c*) shows a view from the rear of label attaching means 11 in which bracing arm 21 is positioned with third bracing surface 39''' in contact with the underside of upper bar 3. In this example the position of bracing surface 39''' on bracing arm 21 causes the front face 61 of label attaching means 11 to be orientated at an angle of 40°, i.e. it faces upwards at an angle of 40°.

In order to permit easy loading of goods onto lower bar 5 label attaching means 11 can be rotated around crosspiece 7 so that bracing surfaces 57', 57" are forced to resiliently pass from the upper side of upper bar 3 to the lower side. After passing the widest part of upper bar 3, bracing surfaces 57', 57" spring back towards each other and rest on the lower surface of upper bar 3 thereby preventing label attaching means 11 from hanging freely in front of lower bar 5 and thereby permitting easy access to lower bar 5.

The example of an embodiment described above can be modified by having more or less bracing surfaces. It is also possible to provide a label attaching means with a plurality of asymmetncally positioned bracing arms each able to individually co-operate with upper bar 3 to give an increased choice of viewing angles. Alternatively label attaching means could be provided with a plurality of pivot means to which a singe bracing arm could be selectively attached.

Figure 6:
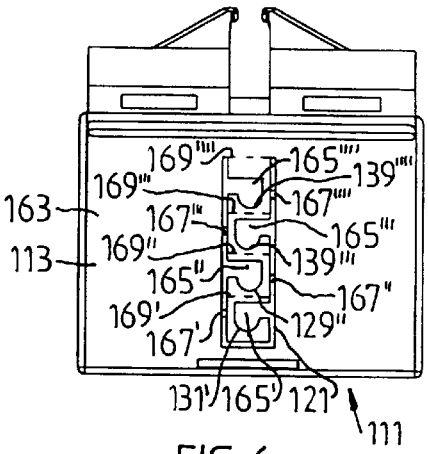
FIG. 6 shows a rear view of a second embodiment of a label attachment means according to the invention, FIGS. 7*a*), 7*b*), 7*c*) shows in a perspective view a third embodiment of an attachment means according to the invention.

FIG. 6 shows a rear view of a second embodiment of a label attaching means 111 in which body 113 is formed with an integral bracing arm 121. Bracing arm 121 is formed from a tongue of label attaching means material surrounded by an elongated U-shaped slot in the rear face 163 of label attaching means 11. Bracing arm 121 extends downwards from a position near the top of rear face 163. Bracing arm 121 has a plurality of laying-down P-shaped cutouts 165', 165", 165''', 165"" spaced along its longitudinal axis, the diameter of each cut-out being equal or greater than the diameter of an upper bar 3 and the inner surfaces of the cutouts forming bracing surfaces 139', 139", 139''', 139"". Bracing arm 121 is joined to the rear face 163 by a plurality of frangible links 167', 167", 167''', 167"" each near a respective P-shaped cutout 165', 165", 165''', 165"". The P-shaped cutouts 165', 165", 165''', 165"" are separated by horizontal scores or grooves 169', 169", 169'''. A further groove 169"" is at the end of arm 121.

These grooves 169'–169"" (represented by dashed lines) facilitate bending parts of bracing arm 121 out of the plane of the rear face 163. The label attaching means 111 is attached to a cross-piece in a similar way to that described above in the first embodiment. If the user desires the label attaching means to hang at a fixed angle then the user breaks as necessary one or more of the frangible links 167'–167''', bends bracing arm 121 along a horizontal score 169', 169" or 169''' out of the plane of the rear face 163 and hooks the first P-shaped cutout 165' onto upper bar 3. The first frangible link 167' could, for example, correspond to an angle of 0°, the second to an angle of 20° and the third to an angle of 40°, the fourth to 60° when the first P-shaped cut-out 165' is hooked onto upper bar 3. Naturally other angles are also possible depending on the spacing of the frangible links 167'–167'''. In addition if other angles are required then another P-shaped cut-out i.e. 165" or 165''' or 165"" can be hooked onto upper bar 3 instead of first P-shaped cut-out 165'.

The above embodiments of the present invention have been illustrated for use with upper bars 3 having a cross-piece 7 mounted under the upper bar. The invention can be easily adapted for use with a bar having a cross-piece mounted above the bar or on the end of the bar by, for example, adapting the angle and/or dimensions of the wings on the clamping members or the height of the rails.

Figure 7A:
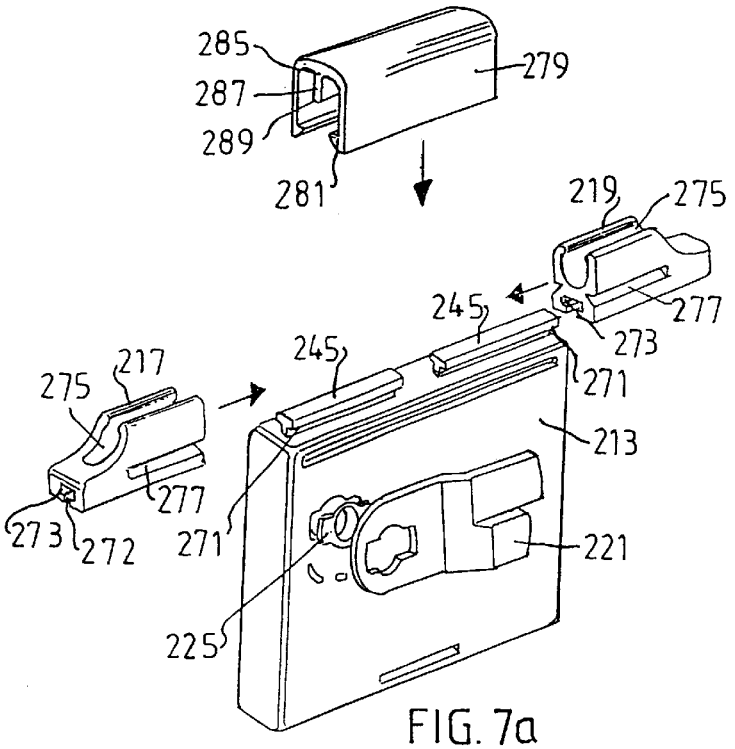

FIG. 7*a*) shows an exploded perspective view of an embodiment of the invention intended for use with U-shaped uppers bars. Body 213 has T-shaped rails 245 each with a snap-lock wedge 271 which can co-operate with a correspondingly shaped snap-lock recess 272 inside the corresponding T-shaped groove 273 at the base of each of the clamping members 217, 219. Clamping members 217, 219 have upper C-shaped or U-shaped grooves 275 for receiving an upper bar, the diameter of the grooves being the same or greater than the diameter of the largest upper bar intended to be received in the grooves 275. Clamping members 217, 219 have longitudinal, lateral snap-lock recesses 277 formed on each side which can co-operate with a U-section clip-on locking piece 279 having corresponding wedge shaped snap-lock edges 281. Locking piece 279 has a length less than or equal to the distance between the arms of the U-shaped upper bar 203. The inside surface of the base 283 of locking piece 279 has a projection 285 which extends parallel to and in the same direction as the arms of the U-shaped locking piece. Projection 285 has a scored line of weakness 287 which makes it possible to easily snap-off the outer portion 289 of projection 285. Body 213 has a pivot means 225 similar to that described above which co-operates with a bracing arm 221.

Figure 7B:
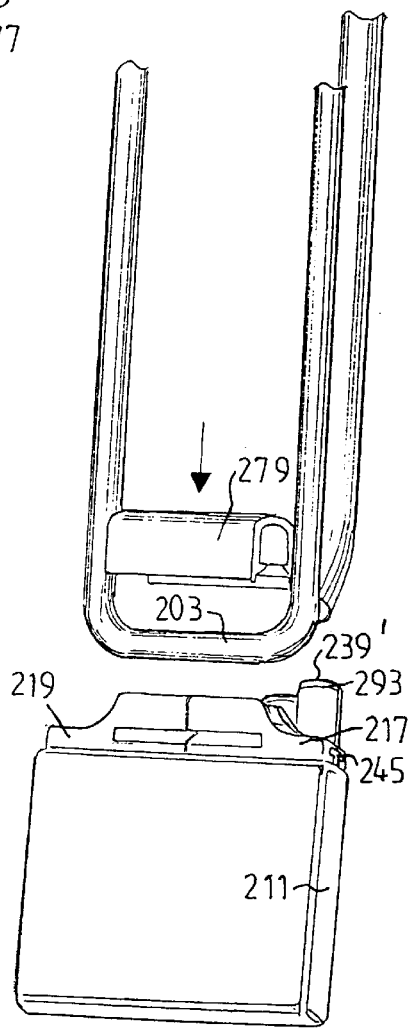

FIG. 7*b*) shows label attaching means 211 with clamping members 217, 219 snapped onto rails 245 and aligned with cross-piece 207 of upper bar 203. Locking piece 279 has had the outer portion 289 of projection 285 removed to accommodate the diameter of upper bar 203. If the label attaching means 211 was to be used with a thinner upper bar then the projection outer portion 289 would be left attached to reduce play in the join between label attaching means 211 and upper bar 203.

Figure 7C:
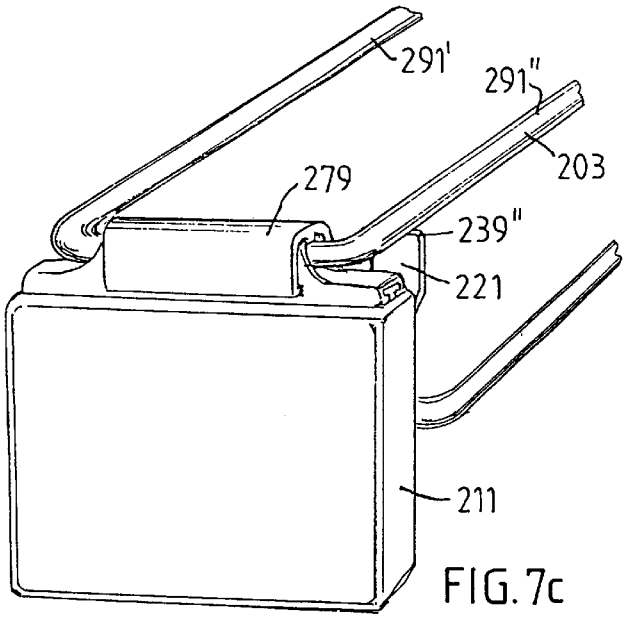

FIG. 7*c*) shows label attaching means 211 attached to upper bar 203 with locking piece 279 snap-fitted onto clamping members 217, 219 and a bracing surface 239" of bracing arm 221 in contact with upper bar 203.

This embodiment can naturally be modified in accordance with the principals mention with respect to the previous embodiments. Bracing arm 221 and pivot means 225 could furthermore be so-positioned that the bracing surfaces of bracing arm can co-operate with either of the arms 291', 291" of upper arm 203 in order to provide a wide range of adjustment angles. Locking piece 279 and/or clamping members 217, 219 can be provided with bracing means such as wings similar to those described earlier or, for example, cut-outs with resilient edges at the ends of locking piece 279 for elastically receiving arms 291', 291", to permit label attaching means 211 to be retain in a loading position. The bracing surfaces 239" can be optionally provided with friction increasing means such in the form of high friction coatings such as, for example a rubber layer 293, or by having roughened surfaces.

In another embodiment of the invention, not shown, the bracing arm can be provided with a plurality of cut-outs to permit it to be attached to the pivoting means in a number of ways in order to provide more possibilities for changing the braced angle of the label attachment means.

In a further embodiment the bracing arm has bracing surfaces provided at both ends of the bracing arm and centrally and/or asymmetrically placed cut-out(s).

The above described embodiments can be modified within the scope of the claims by providing a plurality of bracing arms as described herein. The above described embodiments have been set forth by way of example and are not intended to limit the claims appended hereto. Accordingly, the claims should be accorded modifications, deviations and improvements readily apparent to a person skilled in the art.

What is claimed is:

1. A label holder for use with a T-shaped support or a U-shaped support, wherein the support is of the type comprising a substantially horizontal cross-piece on a supporting arm, said label holder comprising:

a label holder means pivotally connected on said cross-piece;

clamping means for clamping said label holder onto the cross-piece; and bracing means operably connected to said label holder means for bracing against said supporting arm, wherein said bracing means comprises a bracing arm with a plurality of bracing surfaces individually selectable for bracing against said supporting arm.

2. The label holder according to claim 1 which is further characterized for use with a T-shaped support.

3. The label holder according to claim 1, wherein said bracing surfaces comprise friction increasing means.

4. The label holder according to claim 1, wherein said bracing arm is an integral part of said label holder means.

5. A label holder according to claim 1 which is further characterized for use with a U-shaped support and includes two supporting arms wherein said substantially horizontal cross-piece connects two supporting arms.

6. A label attaching means for use with a T-shaped support or a U-shaped support wherein the support is of the type comprising a substantially horizontal cross-piece on a supporting arm, said label attaching means comprising:

a label holder means pivotally connected to said cross-piece; and bracing means operably connected to said lalbel holder for bracing against said supporting arm wherein said bracing means comprises a bracing arm with a plurality of bracing surfaces individually selectable for bracing against said supporting arm.

7. The label attaching means according to claim 6 which is further characterized for use with said T-shaped support wherein said supporting arm connects adjacent an intermediate portion of said cross-piece.

8. The label attaching means according to claim 6 wherein said bracing surfaces comprise friction increasing means.

9. The label attaching means according to claim 8 wherein said bracing arm is an integral part of said label attaching means.

10. A label attaching means according to claim 6 which is further characterized to be for use with said U-shaped support, and includes two supporting arms wherein said substantially horizontal cross-piece connects two supporting arms.

11. The label attaching means according to claim 10 wherein said bracing surfaces comprise friction increasing means.

12. The label attaching means according to claim 10 wherein said bracing arm is an integral part of said label attaching means.

* * * * *